US010939717B2

(12) United States Patent
Shepherd

(10) Patent No.: US 10,939,717 B2
(45) Date of Patent: Mar. 9, 2021

(54) HEADGEAR WITH ILLUMINATED DECORATIVE PIECE

(71) Applicant: Jana Shepherd, Azle, TX (US)

(72) Inventor: Jana Shepherd, Azle, TX (US)

( * ) Notice: Subject to any disclaimer, the term of this patent is extended or adjusted under 35 U.S.C. 154(b) by 0 days.

(21) Appl. No.: 16/531,037

(22) Filed: Aug. 3, 2019

(65) Prior Publication Data

US 2021/0030096 A1 Feb. 4, 2021

(51) Int. Cl.
*A42B 1/24* (2021.01)
*A42B 1/06* (2021.01)
*A42B 1/244* (2021.01)

(52) U.S. Cl.
CPC ..... *A42B 1/244* (2013.01); *A42B 1/062* (2013.01)

(58) Field of Classification Search
CPC ..... A42B 1/244; A42B 1/062
See application file for complete search history.

(56) References Cited

U.S. PATENT DOCUMENTS 5,680,718 A * 10/1997 Ratcliffe ..... A42B 1/248 2/195.1
6,167,570 B1 * 1/2001 Su ..... A42B 1/248 2/209.13
6,168,286 B1 * 1/2001 Duffy ..... A42B 1/242 362/105
7,490,364 B2 * 2/2009 Kim ..... A42B 1/248 2/209.13
9,489,016 B2 * 11/2016 Malek ..... G06F 1/163
9,603,402 B2 * 3/2017 Warner ..... A63F 13/00
9,808,041 B2 * 11/2017 Cabral ..... A42B 1/244
10,159,294 B2 * 12/2018 Waters ..... A42B 1/244
2006/0165160 A1 * 7/2006 Winningstad ..... G11B 27/3027 375/219
2006/0212994 A1 * 9/2006 Proctor ..... A42B 1/244 2/171
2007/0064413 A1 * 3/2007 Slater ..... A42B 1/244 362/106
2007/0171628 A1 * 7/2007 Seade ..... A42B 1/245 362/106
2008/0130272 A1 * 6/2008 Waters ..... G02C 11/04 362/106
2010/0313334 A1 * 12/2010 Moy ..... A42B 1/248 2/209.13

(Continued)

*Primary Examiner* — Tsion Tumebo

(74) *Attorney, Agent, or Firm* — Keith Miller Patent Law, PLLC; Keith Miller; Amber Whigham

(57) ABSTRACT

Provided is an article of wearing apparel having a decorative illuminable assembly. The wearing apparel includes a crown section, a bill section attached at one end to a bottom edge of the crown section, a decorative illuminable assembly secured to the crown section, a charging port integrated with the crown section, and a weatherproof port cover. The decorative illuminable assembly has a design shape, at least one light emitting diode, and a power switch which connects the at least one light emitting diode with a rechargeable battery. The charging port is configured to allow charging of the of the rechargeable battery via electronic connection of a mobile device charger. In an embodiment, the article of wearing apparel is a baseball cap and the charging port is positioned centrally on a frontward facing portion of the crown section when the bill section is facing the front of a wearer.

20 Claims, 3 Drawing Sheets

(56) References Cited

U.S. PATENT DOCUMENTS

| | | | | |
|---|---|---|---|---|
| 2013/0192961 | A1* | 8/2013 | Waters | B65D 43/02<br>220/379 |
| 2013/0198935 | A1* | 8/2013 | Waters | A42C 5/00<br>2/209.13 |
| 2014/0173807 | A1* | 6/2014 | Waters | A42B 1/244<br>2/209.13 |
| 2017/0325532 | A1* | 11/2017 | Gerpheide | H05B 47/12 |

* cited by examiner

HEADGEAR WITH ILLUMINATED DECORATIVE PIECE

FIELD OF THE INVENTION

The instant disclosure relates generally to illuminated wearing apparel, and in particular, to an article of wearing apparel such as a headgear including a hat or visor, or other headgear, having an illuminated and/or illuminable decorative piece.

BACKGROUND

Wearing apparel has long been a way for a wearer to express his or her personality and/or to advertise or promote a business, school, sports team, or other such organization. As such, people commonly wear apparel having decorative designs attached thereto, printed, painted, or sewed thereon, or otherwise incorporated within the wearing apparel. The use of illuminating devices incorporating a light emitting diode (LED) for illuminating a decoration or design on wearing apparel such as hats, shirts, shoes, or other wearable articles, is also well known. However, it is common for wearing apparel with illuminating devices to require connection to a rechargeable battery or to require new or recharged batteries to continue functioning as desired.

Accordingly, there exists a need to provide a way for wearing apparel having illuminating devices to light a decoration or design to charge the illuminating device without taking away from an aesthetic quality of the wearing apparel. Additionally, the wearing apparel needs to be durable and/or allow for normal wear and tear despite the charging feature.

SUMMARY

An embodiment of this disclosure provides an article of wearing apparel having a decorative illuminable assembly, the article of wearing apparel including a crown section with a bottom edge, a bill section attached at one end to the bottom edge of the crown section, a decorative illuminable assembly secured to the crown section, and a charging port attached to or integrated with the crown section. The decorative illuminable assembly has a design shape, at least one light emitting diode, and a power switch which connects the at least one light emitting diode with a rechargeable battery disposed in a hidden, inside portion of the wearing apparel. The charging port is configured to allow charging of the rechargeable battery via electronic connection of a mobile device charger with the rechargeable battery. In an embodiment, the article of wearing apparel is a baseball cap or visor, and the charging port is positioned centrally on a frontward facing portion of the crown section under the decorative illuminable assembly when the bill section is facing the front of a wearer. Another embodiment of the disclosure further includes a port cover configured to cover the charging port from an outside atmosphere.

Another embodiment of this disclosure provides a decorative illuminable assembly for a wearable apparel which includes a design shape, at least one light emitting diode, a power switch that connects the at least one light emitting diode with a rechargeable battery, and a charging port configured to allow charging of the rechargeable battery via electronic connection of a mobile device charger with the rechargeable battery. In an embodiment, the design shape is alphanumeric or graphical content, a company logo, brand name, or other promotional, fashion, or design insignia. In another embodiment of the disclosure, the decorative illuminable assembly further includes a port cover configured to cover the charging port from an outside atmosphere.

BRIEF DESCRIPTION OF THE DRAWINGS

Figure 1:
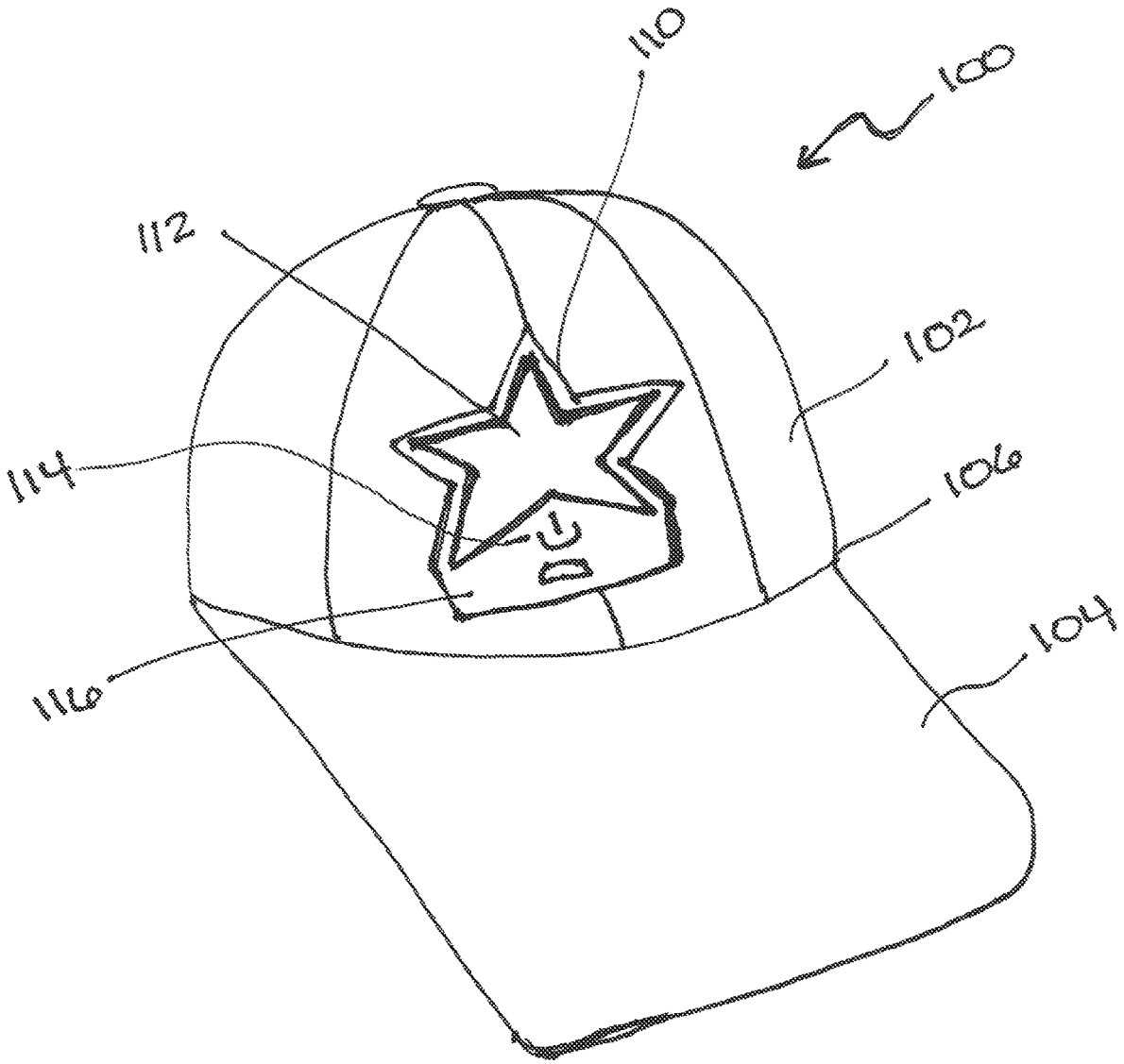
Figure 2:
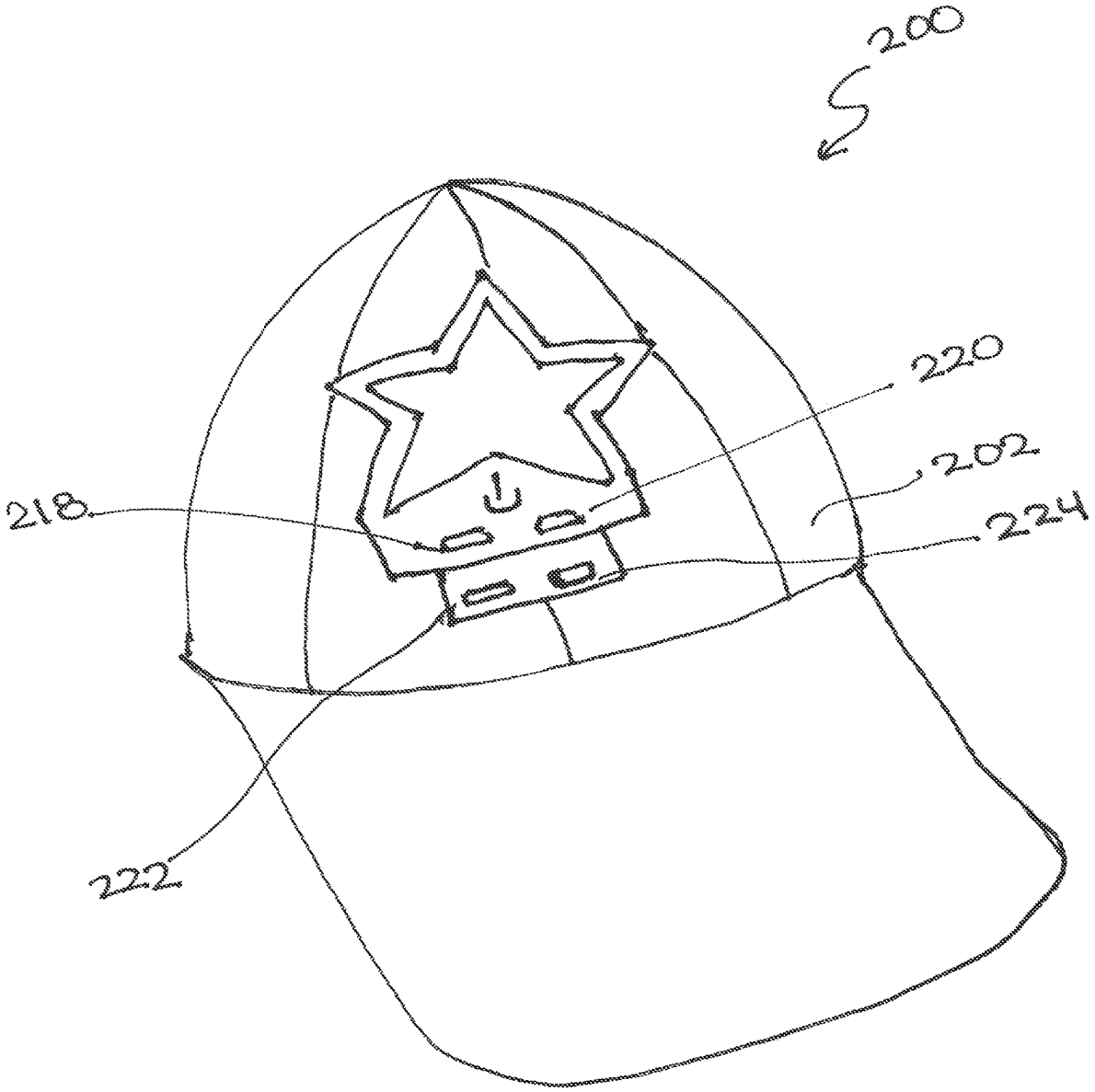
Figure 3:
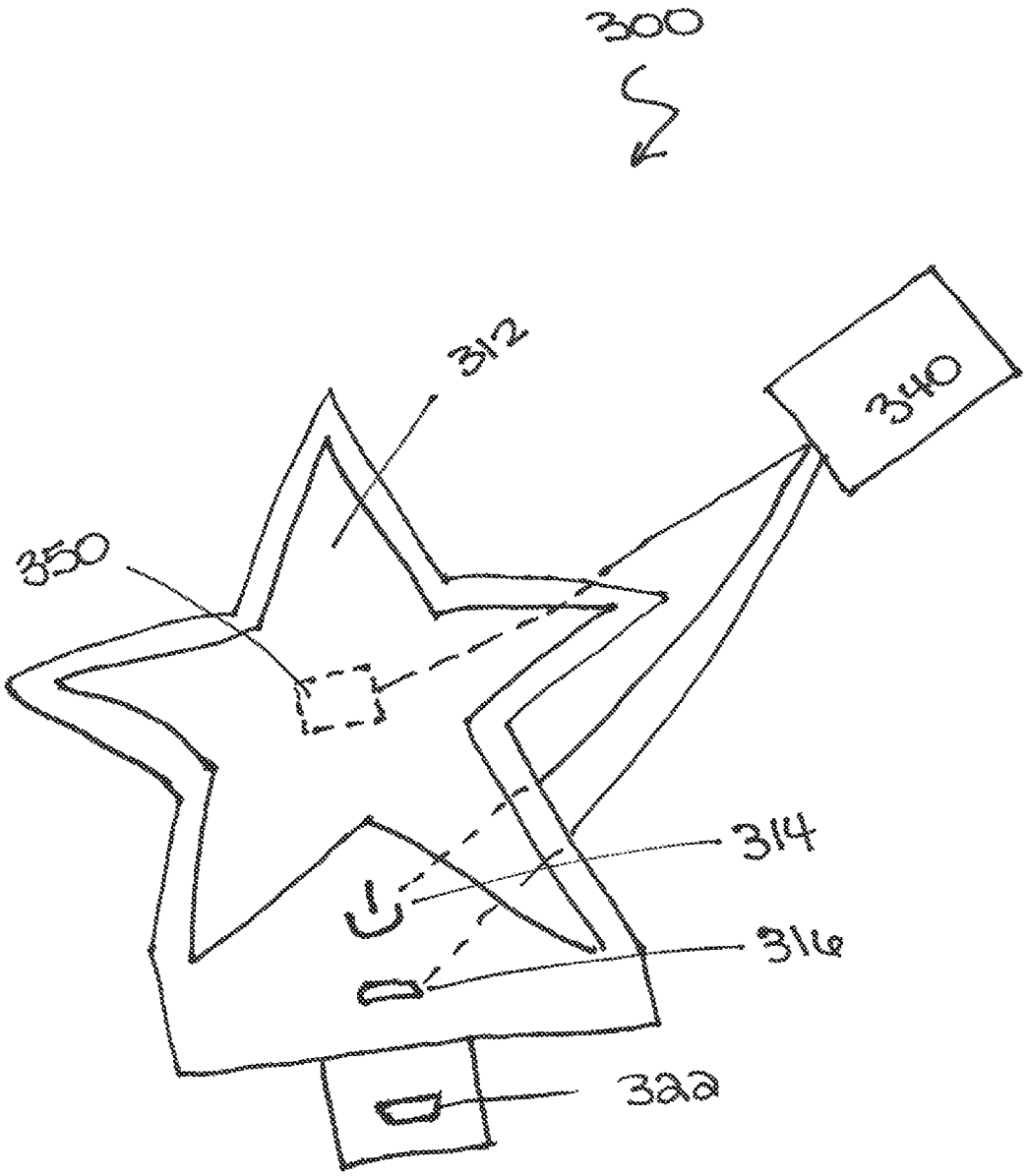

Having thus described examples of the disclosure in general terms, reference will now be made to the accompanying drawings, which are not necessarily drawn to scale, and wherein like reference characters designate the same or similar parts throughout the views. The particular objects and features of the instant disclosure as well as the advantages related hereto will become apparent from the following description taken in connection with the accompanying drawings, and wherein:

FIG. 1 is an illustration of an article of wearing apparel having a decorative illuminable assembly according to an embodiment of the disclosure;

FIG. 2 is an illustration of an article of wearing apparel having a decorative illuminable assembly according to an embodiment of the disclosure;

FIG. 3 is an illustration of a decorative illuminable assembly according to an embodiment of the disclosure.

DETAILED DESCRIPTION

The following description of the disclosed embodiments of this disclosure is intended to enable someone skilled in the prior art to make and use that which is disclosed, but is not intended to limit the claims to these particular exemplary embodiments.

With initial reference to FIG. 1, there is illustrated an article of wearing apparel 100 according to an embodiment of the disclosure. As shown, the article of wearing apparel 100 includes a crown section 102 and a bill section 104 which attaches at one end to a bottom edge 106 of the crown section. A decorative illuminable assembly 110 is secured to the crown section 102 and includes a design shape 112, at least one light emitting diode (LED) (not shown) and a power switch 114. The power switch 114 connects the at least one light emitting diode with a rechargeable battery (not shown) disposed in a hidden, inside portion of the wearing apparel. The power switch provides power from the rechargeable battery to the at least one LED when the power switch is in an "ON" position or when a wearer presses the power switch at a time when the power switch is in an "OFF" position. Moreover, the power switch interrupts power flowing from the rechargeable battery to the at least one LED when the switch is in an "OFF" position or when a wearer presses the power switch when the power switch is already in the "ON" position.

Also included in FIG. 1 is a charging port 116 attached to or integrated with the crown section 102 of the wearing apparel. The charging port 116 allows charging of the rechargeable battery via connection of a mobile device or cell phone charger with the port. FIG. 1 illustrates the charging port 116 positioned centrally on a frontward facing portion of the crown section under the decorative illuminable assembly when the bill section is facing the front of a wearer. However, it should be understood that in various embodiments of this disclosure the charging port may be positioned in any location or place on the crown section of the wearing apparel.

In various embodiments of the disclosure, the wearing apparel may be a hat, such as a baseball cap, visor, cowboy hat, beanie, or any such accessory a wearer might put on their head. In other embodiments, a wearing apparel can be a shirt, jacket, shorts, pants, shoes, belt, or other article of clothing or accessory a person or animal might wear.

In an embodiment, the decorative illuminable assembly 110 may be attached to the crown section 102 via embroidered stitching around an edge thereof which is sewn so as to extend through a fabric of the crown section. In other embodiments, the decorative illuminable assembly may secure to the crown section 102 via hot glue, a pin, staple, a hook and loop fastener, or other adhesive or fastening mechanism. In an embodiment, the decorative illuminable assembly is permanently affixed to the wearing apparel. Alternatively, in another embodiment, the decorative illuminable assembly is removably attached to the article of wearing apparel.

In various embodiments of the disclosure, the design shape 112 may include alphanumeric or graphical content, a company logo, brand name, or any other decorative, promotional, fashion, or design insignia.

As shown in FIG. 1, the charging port may be a single charging port for attachment of a cell phone charger.

Referring to FIG. 2, an embodiment of the disclosure illustrates an article of wearing apparel 200 having two cell phone charging ports disposed on the crown section 202 such that one allows for charging via an Apple® i-Phone® device charging cord 218 and another for attachment of an Amazon®, Samsung®, Android®, or non-i-phone device charging cord 220. In an embodiment, the two cell phone charging ports may be disposed side by side on the crown section 202 under the power switch 214 and centered above the bill section 204.

In an embodiment, the article of wearing apparel 200 may further include port covers 222 and 224 which are made of a weatherproof or waterproof material. The port cover or covers comprise a flexible, hanging piece of material attached to an area adjacent to the charging port or ports and are able to bend over and insert into the corresponding charging ports. Port covers 222 and 224 are able to substantially prevent outside air and humidity to enter into the charging ports from the surrounding atmosphere. That is, when it is raining outside or when the wearing apparel is exposed to high levels of humidity, a wearer is able to prevent water and other debris from entering and potentially damaging the charging ports when the port covers are inserted into the charging ports compared to when the charging ports are open and/or the port covers are not in an inserted position.

In various embodiments, port covers 222 and 224 may remain in an open, uninserted position, or may be inserted into the charging ports in a closed position. In an embodiment, the port cover is removably attachable to the article of wearing apparel, while in another embodiment the port cover is not removable or detachable from the article of wearing apparel. In some embodiments, a port cover may be positioned to the side of a corresponding charging port such that the flexible flap surrounding the port cover bends in a sideways direction to allow insertion of the port cover to cover and close, or to open a charging port. Alternatively, a port cover may be positioned above or below a corresponding charging port such that the flexible flap bends in an up and down direction to cover or open a charging port. The flexible flap may be made of a rubber material.

Referring now to FIG. 3, an embodiment of the disclosure provides a decorative illuminable assembly for a wearable apparel, the decorative illuminable assembly 300 including a design shape 312, at least one light emitting diode (LED) 350, a power switch 314 configured to connect the at least one light emitting diode 350 with a rechargeable battery 340, and a charging port 316. As illustrated in FIG. 3, the at least one LED is positioned behind or under the decorative illuminable assembly. A material of the design shape may allow the LED to shine through the design shape, or alternatively, the material may not allow the LED to shine through, and instead cause the LED light to appear to come from behind the design shape. Thus, the design shape material may be translucent or solidly colored, and the material may be a cloth or fabric type of material, or it may be any other type of material, such as rubber.

As discussed above regarding FIG. 1, the charging port 316 allows charging of the rechargeable battery 340 via electronic connection of a mobile device charger. Various embodiments of the disclosed decorative illuminable assembly 300 can be attached to any article of wearing apparel, but it does not have to be. That is, the decorative illuminable assembly 300 will function on its own and can be turned on and off via power switch 314 and can be charged via insertion of a cell phone charger into charging port 316. As such, the decorative illuminable assembly may be attached to any suitable object or material including non-wearable apparel, accessories, or otherwise.

In an embodiment of the disclosure, the decorative illuminable assembly 300 may include more than one charging port. In another embodiment, each of the multiple charging ports may have a corresponding port cover, as discussed above regarding claim 1.

Different examples and aspects of the article of wearing apparel and decorative illuminable assembly are disclosed herein that include a variety of components, features, and functionality. It should be understood that the various examples and aspects of the wearing apparel and decorative illuminable assembly disclosed herein may include any of the components, features, and functionality of any of the other examples and aspects disclosed herein in any combination, and all of such possibilities are intended to be within the spirit and scope of the present disclosure.

Many modifications and other examples of the disclosure set forth herein will come to mind to one of ordinary skill in the art to which the disclosure pertains having the benefit of the teachings presented in the foregoing descriptions and the associated drawings.

What is claimed is:

1. An article of wearing apparel having a decorative illuminable assembly, the wearing apparel comprising:

a crown section having a bottom edge;

a bill section attached at one end to the bottom edge of the crown section;

the decorative illuminable assembly secured to the crown section, wherein the decorative illuminable assembly comprises a design shape, at least one light emitting diode, and a power switch configured to connect the at least one light emitting diode with a rechargeable battery disposed in a hidden, inside portion of the wearing apparel; and a charging port integrated with the crown section and positioned centrally on a frontward facing portion of the crown section under the decorative illuminable assembly when the bill section is facing a front of a wearer, wherein the charging port is configured to allow charging of the rechargeable battery via electronic connection of a mobile device charger with the rechargeable battery; and wherein the decorative illuminable assembly is removably attachable to the article of wearing apparel.

2. The article of wearing apparel of claim 1, wherein the article of wearing apparel is a baseball cap or a visor.

3. The article of wearing apparel of claim 1, wherein the design shape comprises alphanumeric or graphical content, a company logo, brand name, or other promotional, fashion, or design insignia.

4. The article of wearing apparel of claim 1, wherein the power switch is configured to provide power from the rechargeable battery to the at least one light emitting diode when the power switch is in an "ON" position or when a wearer presses the power switch; and wherein the power switch is configured to interrupt power flowing from the rechargeable battery to the at least one light emitting diode when the switch is in an "OFF" position or when a wearer presses the power switch when the power switch is already in an "ON" position.

5. The article of wearing apparel of claim 1, further comprising a port cover configured to cover the charging port from an outside atmosphere.

6. The article of wearing apparel of claim 5, wherein the port cover comprises a flexible, hanging piece of material attached to an area adjacent to the charging port and configured to bend over and insert into the charging port substantially preventing outside air and humidity to enter into the charging port from the outside atmosphere.

7. The article of wearing apparel of claim 6, wherein the port cover is configured to remain in an open, uninserted position.

8. The article of wearing apparel of claim 6, wherein the port cover is removably attachable to the article of wearing apparel.

9. The article of wearing apparel of claim 6, wherein the port cover is configured to bend in a sideways direction to cover and close, or to open the charging port.

10. The article of wearing apparel of claim 9, wherein the port cover comprises a rubber material.

11. The article of wearing apparel of claim 6, wherein the port cover is configured to bend in an up and down direction to cover or open the charging port.

12. The article of wearing apparel of claim 6, wherein the charging port comprises one or more cell phone charging ports configured for charging an Apple® i-Phone® device or an Android® device.

13. The article of wearing apparel of claim 1, wherein the decorative illuminable assembly is removably attachable to the article of wearing apparel via a pin or a hook and loop fastener.

14. A decorative illuminable assembly for a wearable apparel, the decorative illuminable assembly comprising:

a design shape comprising a piece of material;

at least one light emitting diode;

a power switch configured to connect the at least one light emitting diode with a rechargeable battery; and a charging port integrated with the piece of material and positioned under the design shape and in a central position with respect to the design shape, wherein the charging port is configured to allow charging of the rechargeable battery via electronic connection of a mobile device charger with the rechargeable battery and wherein the decorative illuminable assembly is removably attachable to a crown portion of the wearable apparel.

15. The decorative illuminable assembly of claim 14, wherein the charging port comprises one or more of a cell phone charging port configured for charging an i-phone Apple device or an Amazon based device.

16. The decorative illuminable assembly of claim 14, wherein the design shape further comprises alphanumeric or graphical content, a company logo, brand name, or other promotional, fashion, or design insignia.

17. The decorative illuminable assembly of claim 14, wherein the power switch is configured to provide power from the rechargeable battery to the at least one light emitting diode when the power switch is in an "ON" position or when a user presses the power switch; and wherein the power switch is configured to interrupt power flowing from the rechargeable battery to the at least one light emitting diode when the switch is in an "OFF" position or when a user presses the power switch when the power switch is already in an "ON" position.

18. The decorative illuminable assembly of claim 14, further comprising a port cover configured to cover the charging port from an outside atmosphere.

19. The decorative illuminable assembly of claim 14, wherein the port cover comprises a flexible, hanging piece of material attached to an area adjacent to the charging port and configured to bend over and insert into the charging port substantially preventing outside air and humidity to enter into the charging port from the outside atmosphere.

20. The decorative illuminable assembly of claim 19, wherein the port cover comprises a rubber, waterproof material.

* * * * *